US009587615B2

(12) United States Patent
Koehler

(10) Patent No.: US 9,587,615 B2
(45) Date of Patent: Mar. 7, 2017

(54) ENGINE STARTER ATTACHMENT FOR BATTERY OPERATED DRILL/DRIVER GUN

(71) Applicant: K Square Machine Works, LLC, Moonachie, NJ (US)

(72) Inventor: Robert H. Koehler, Secaucus, NJ (US)

(73) Assignee: K Square Machine Works, LLC, Moonachie, NJ (US)

( * ) Notice: Subject to any disclaimer, the term of this patent is extended or adjusted under 35 U.S.C. 154(b) by 83 days.

(21) Appl. No.: 14/618,560

(22) Filed: Feb. 10, 2015

(65) Prior Publication Data

US 2016/0230738 A1 Aug. 11, 2016

(51) Int. Cl.

| | |
|---|---|
| ***F02N 1/00*** | (2006.01) |
| ***F02N 15/02*** | (2006.01) |
| ***F02N 11/12*** | (2006.01) |
| *F02N 11/00* | (2006.01) |
| *F02N 11/14* | (2006.01) |

(52) U.S. Cl.

CPC ..... *F02N 15/022* (2013.01); *F02N 11/12* (2013.01); *F02N 11/00* (2013.01); *F02N 11/14* (2013.01)

(58) Field of Classification Search

CPC ..... F02N 11/12; F02N 15/022; F02N 1/00; F02N 11/00; F02N 11/14; F02B 75/34; B64F 1/34

USPC ..... 123/179.27, 185.1, 185.7, 185.12

See application file for complete search history.

(56) References Cited

U.S. PATENT DOCUMENTS

| | | | | | |
|---|---|---|---|---|---|
| 2,843,101 | A * | 7/1958 | Hubert | F02N 7/14 | 123/179.26 |
| 2,901,911 | A * | 9/1959 | Duncan | F02N 7/14 | 123/179.26 |
| 3,885,544 | A * | 5/1975 | Pfeiffer | F02N 11/12 | 123/179.26 |
| 4,365,596 | A * | 12/1982 | Bennett, Sr. | F02N 11/12 | 123/179.26 |
| 4,372,263 | A * | 2/1983 | Costa | F02N 11/12 | 123/179.26 |
| 4,531,482 | A * | 7/1985 | Scheckel | F02N 11/12 | 123/179.26 |
| 4,569,315 | A * | 2/1986 | Bodnar | F02N 11/12 | 123/179.26 |
| 5,345,900 | A * | 9/1994 | Wisegerber | F02N 3/02 | 123/179.24 |
| 6,595,090 | B1 * | 7/2003 | McQuillin | B25B 27/0035 | 123/179.26 |
| 7,305,956 | B2 * | 12/2007 | Thomas | F02N 11/12 | 123/179.27 |
| 7,530,340 | B1 * | 5/2009 | Jellinek | F02N 11/10 | 123/179.1 |

* cited by examiner

*Primary Examiner* — Hai Huynh

(74) *Attorney, Agent, or Firm* — Richard Malagiere, Esq.

(57) ABSTRACT

A device designed to be a fixture for a commercially available battery operated drill/driver gun to start an internal combustion engine such as a model airplane engine by pressing the device onto the nose cone of the engine. The portion of the device which comes into contact with the nose cone of the engine is a cylinder connected to a shaft with a one way clutch. A rubber or silicone adapter is inserted into the cylinder attached to the shaft; the adaptor cone of the engine fits into the rubber or silicone adapter on the device.

13 Claims, 6 Drawing Sheets

ENGINE STARTER ATTACHMENT FOR BATTERY OPERATED DRILL/DRIVER GUN

FIELD OF INVENTION

The present invention relates to device to be used on a commercially available battery operated drill/driver gun to start an internal combustion engine including but not limited to a model airplane engine. Model airplanes are powered by either electric motors or fuel fed engines. The fuel feed variety of model airplanes are either powered by nitromethane or gasoline. In either case, most often, these fuel-type engines are started by means of an external electric starter powered by a battery. The motor of the electric starter powers a shaft onto which a nose cone adapter is connected to allow the electric starter to engage the nose cone of the model airplane engine when starting. An electric motor powered starter device is particularly suited to this application because the electric motor will not impede the motion of the model airplane nose cone when the engine begins to start and run on its own.

Small internal combustion engines are often used to power out door home or farm machines including but not limited snow blowers, weed whackers, lawn mowers, tractors and chain saws. A cone adapter is attached to the engine crankshaft and used to turn the engine over for starting as a by-pass or substitute for the typical pull cord found on these devices. Again, an electric motor powered starter device is particularly suited to this application because the electric motor will not impede the motion of the internal combustion engine cone adapter when the engine begins to start and run on its own.

The present invention is directed to a fixture to be applied to a commercially available battery operated drill/driver impact gun which allows it to act as a starter for an internal combustion powered engine including but not limited to model airplane engines.

BACKGROUND OF INVENTION

Model airplanes powered by nitromethane or gasoline fuels require a starter to crank the engine in order for it to start. Often the starter is a device powered by an electric motor used to rotate the crankshaft and piston of the engine to draw fuel into the engine. This rotation of the crankshaft connected to the piston pulls fuel into the engine and forces the compression of this fuel in the piston cylinder where an ignition source is located. Once the fuel ignites, the engine starts to operate on its own as an internal combustion engine and the electrical starter device is removed.

Small internal combustion engines are often used to power out door home or farm machines including but not limited snow blowers, weed whackers, lawn mowers, tractors and chain saws. A cone adapter is attached to the engine crankshaft and used to turn the engine over for starting as a by-pass or substitute for the typical pull cord found on these devices. Again, an electric motor powered starter device is particularly suited to this application because the electric motor will not impede the motion of the internal combustion engine cone adapter when the engine begins to start and run on its own.

The electrical starter is most often outfitted with an adapter into which the nose cone housing the engine propeller which is mounted on the engine crankshaft is inserted. When the electrical starter turns the nose cone, it turns the crankshaft of the engine which draws fuel into the engine and moves the piston in the piston cylinder. Once the fuel air mixture ignites, the engine catches and begins to run. At this moment, when the engine begins to run on its own power—prior to the electric starter device being removed from the nose cone—the engine crankshaft turns faster than the electric starter. The electric starter accommodates this additional speed and freely spins along with the nose cone.

It is the object of the present invention to provide a fixture for a commercially available battery operated drill/driver gun to allow it to be used to start internal combustion powered engines including but not limited to a model airplane engine. Commercially available drill/driver guns are powered by gears to produce the necessary torque for the applications for which these guns are designed. This gear drive provides the torque to turn an internal combustion engine crankshaft and piston; however, this same gear drive prohibits the engine from turning faster than the drill/driver gun at the moment the engine catches and starts to run on its own.

The present invention features a shaft attached to a cylinder which accepts a rubber or silicone insert that fits onto the nose cone of a model airplane or cone adapter of any small internal combustion engine. The shaft is attached to the cylinder by means of a one way clutch which allows the torque of the drill/driver gun to be applied to a gasoline powered engine including a model airplane engine while also allowing the engine to speed up faster than the drill/driver is spinning when the engine starts to run on its own.

SUMMARY OF INVENTION

A device used to adapt a commercially available battery powered drill/driver gun for use as a starter for internal combustion powered engines including model airplane engines. A shaft is attached to a cylinder into which a rubber or silicone adapter is inserted. The rubber or silicone adapter is fitted onto the nose cone of a model airplane or a cone adapter of any small internal combustion engine. The shaft and cylinder are attached by means of a one way clutch. The one way clutch allows the gear driven drill/driver gun to turn the cylinder with the necessary torque to crank the internal combustion engine while allowing the cylinder to be spin as fast as the engine when the engine starts to operate under its own power. This feature allows the device to turn the engine drive crankshaft with sufficient torque to start the engine while not prohibiting the engine from rotating faster than the cylinder attached to the drill/driver gun when the engine starts running.

DETAILED DESCRIPTION OF INVENTION

Figure 1:
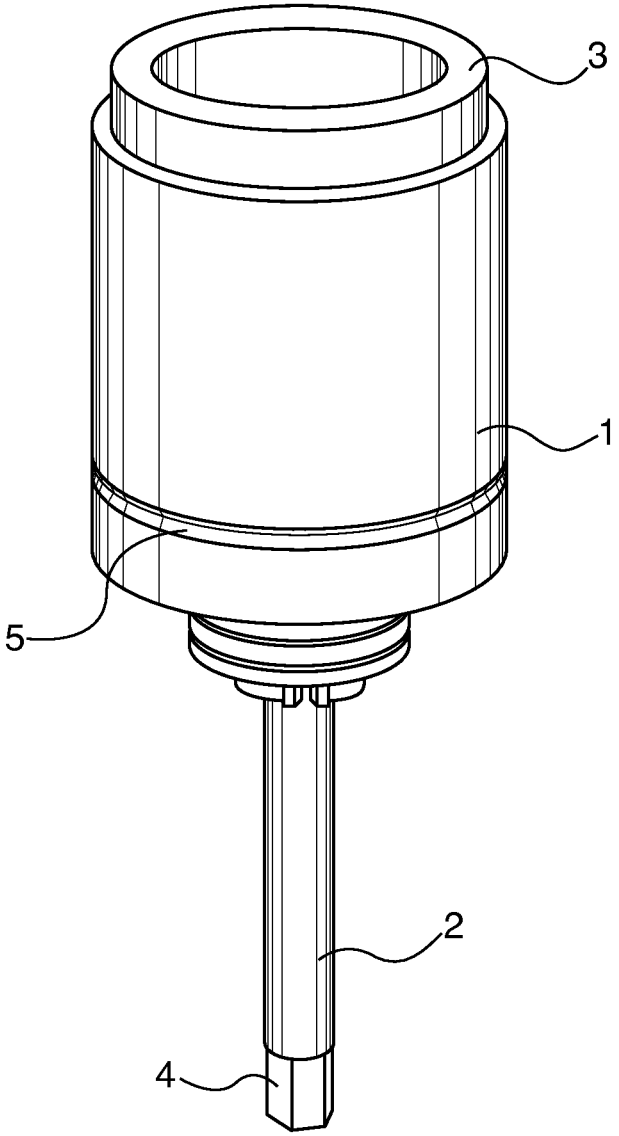
FIG. 1 is an isometric view of the invention.

The present invention will now be described in terms of the presently preferred embodiment thereof as illustrated in the drawings. Those of ordinary skill in the art will recognize that many obvious modifications may be made thereto without departing from the spirit or scope of the present invention.

Figure 4:
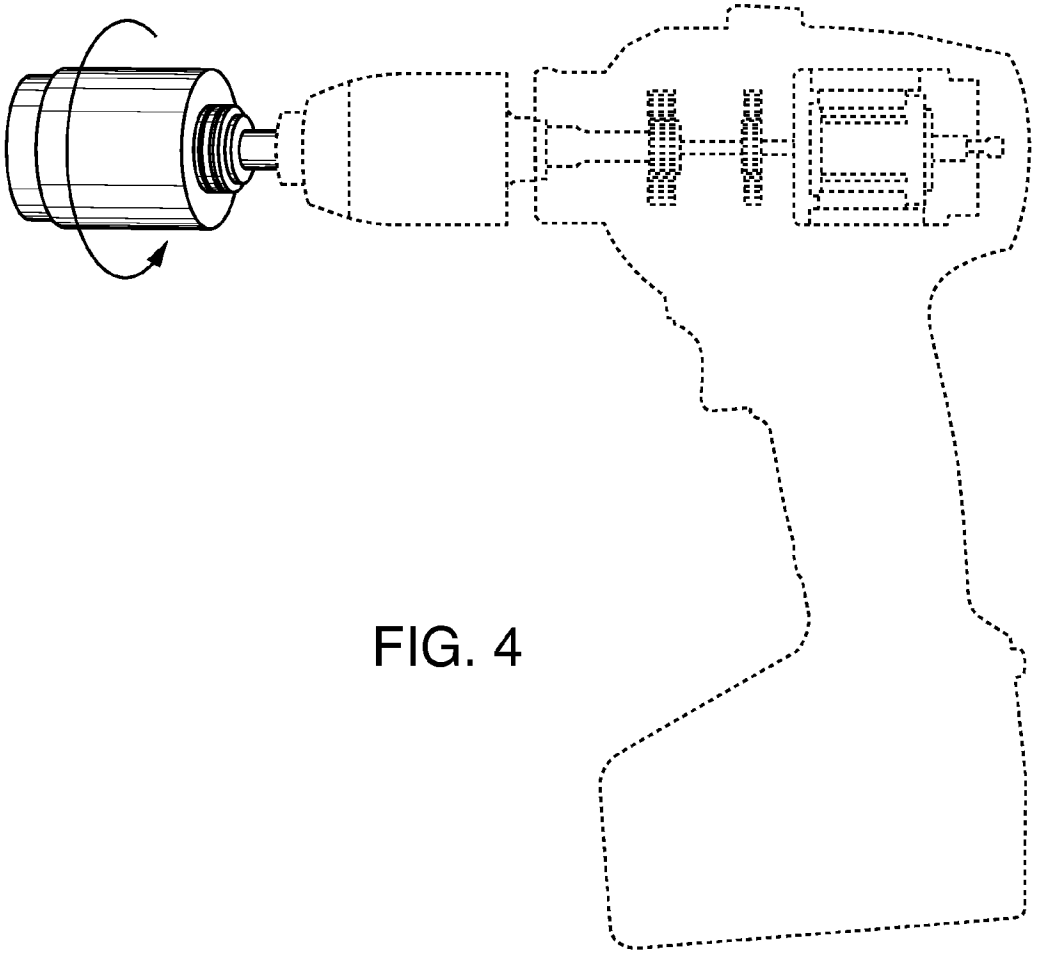
FIG. 4 is a view showing the device inserted into a drill/driver gun.
Figure 5:
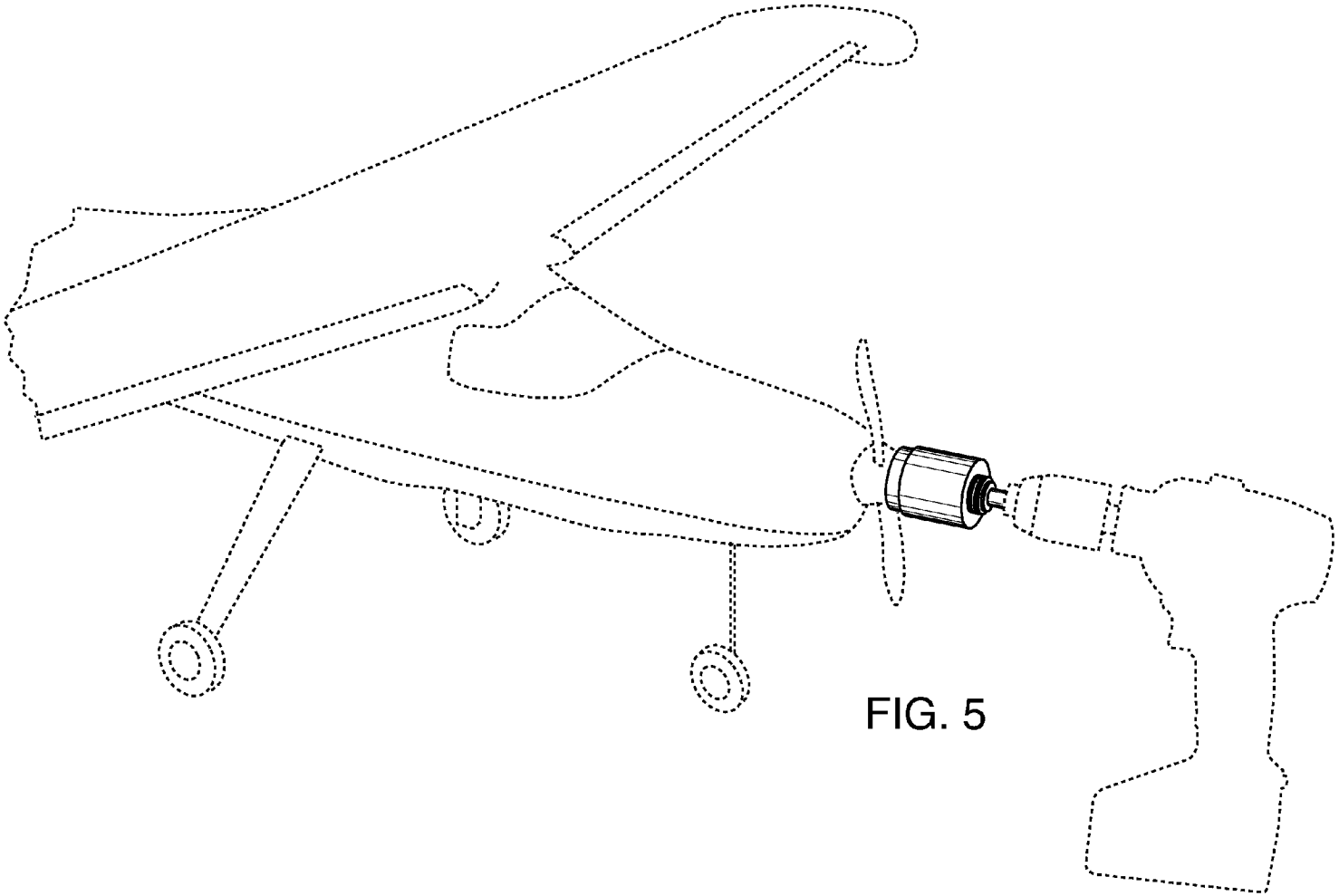
FIG. 5 is a view showing the device inserted into a drill/driver gun and applied to a model airplane.
Figure 6:
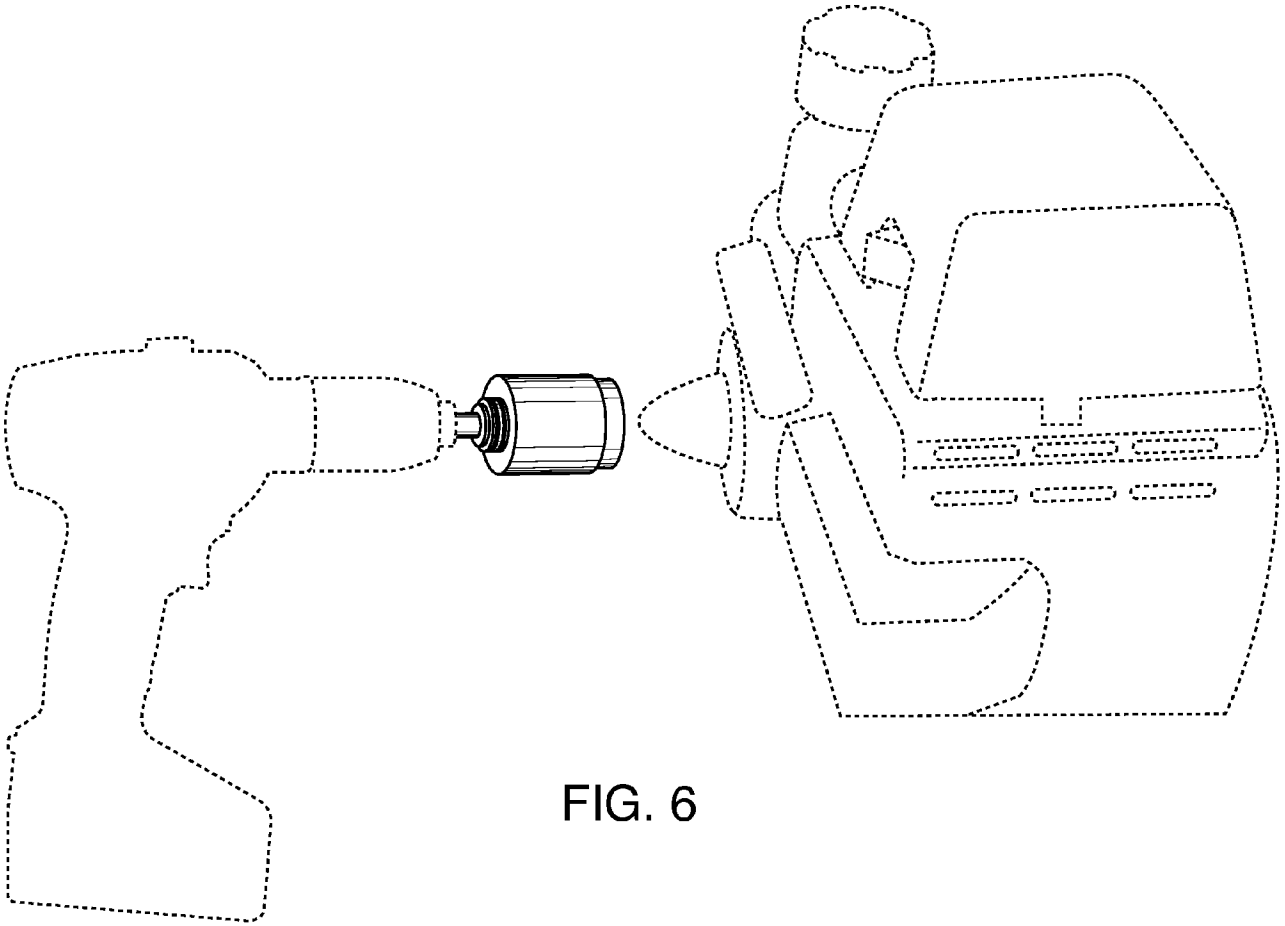
FIG. 6 is a view showing the device inserted into a drill/driver gun and applied to a weed whacker

The present invention is directed to a device for a commercially available battery operated drill/driver gun. Specifically, the device is a tool designed to be set in the chuck of the drill driver/gun. FIG. 4. When affixed to the drill/driver gun, the device converts a standard battery operated drill/driver gun into a starter for an internal combustion engine including but not limited to a model airplane internal combustion engine. FIG. 5 and FIG. 6.

Figure 2:
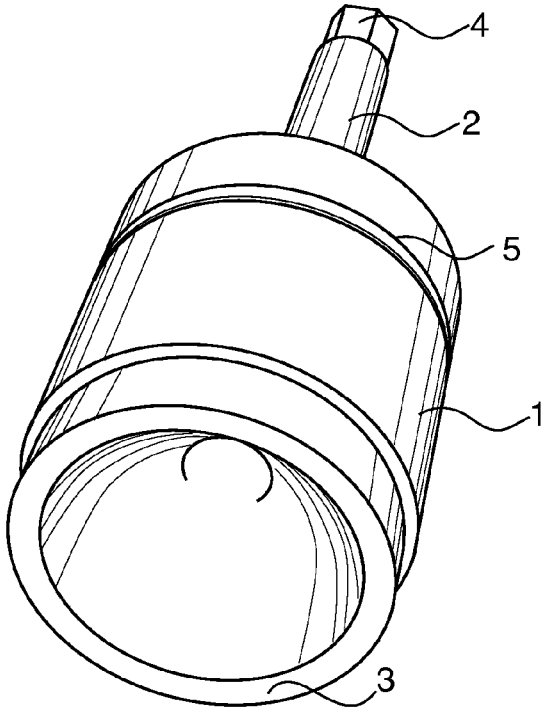
FIG. 2 is an isometric view of the invention showing the inside of the rubber or silicone adapter.

The device comprises a shaft (2) affixed to a cylinder (1). FIG. 1. The cylinder (1) is made of aluminum, plastic or other similar material which is machineable and light weight. A rubber or silicone insert (3) is pressed into the cylinder (1). FIG. 1 and FIG. 2. The rubber or silicone insert (3) is configured with a cavity that allows it to fit over a cone adaptor attached to a model airplane nose cone when starting a model airplane engine. FIG. 5 and FIG. 6. The rubber or silicone insert is removable so that different nose cone configurations can be accommodated. The opposite end of shaft (2) is configured in a hexagonal cross section (4) in order for the device to fit directly into the chuck of a drill/driver or into a hexagonal socket driver. FIG. 2.

Figure 3:
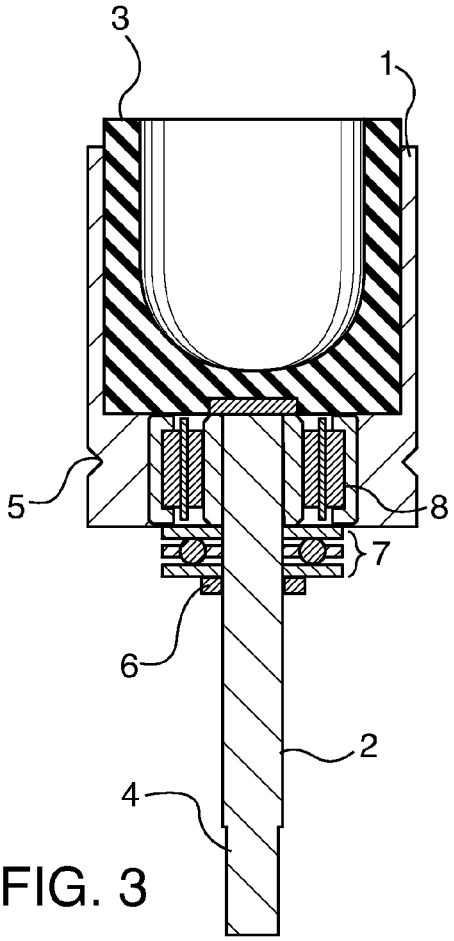
FIG. 3 is a cross sections view of the invention

A commercially available miniature one direction clutch mechanism (8)—such as the one available by JTEKT Corporation—is press fit into the end of the cylinder (1) opposite the end where the rubber or silicone inset (3) is located. FIG. 3. The one direction clutch (8) allows motion only in the direction that the model airplane engine is to be rotated in order to start. FIG. 3 and FIG. 4. The shaft (2) is passed through the cylinder (1) on the rollers of the one direction clutch (8). FIG. 3. The shaft (2) running on the one direction clutch (8) rollers is affixed to the cylinder (1) by a thrust bearing (7)—a rolling element bearing—retained by a snap ring (6). Into this arrangement, the rubber or silicone insert (3) is pressed into the cylinder (1) on the end opposite the one direction clutch mechanism (8).

The hexagonal end (4) of shaft (2) of the device is then inserted into a commercially available battery operated drill/driver gun. FIG. 4. The device is interfaced with the drill/driver gun in one of two ways. First, the hexagonal end of the device is inserted directly into the chuck of the drill/driver and then tightened down in the chuck. FIG. 4. Second, the hexagonal end of the device is inserted directly into a hexagonal nut driver already set into the chuck of the drill/driver gun.

The device attached to the drill/driver is then pushed onto the nose cone of a model airplane engine mounted in a model airplane. FIG. 5. The drill/driver is activated and the nose cone of the model airplane is spun in a counter-clockwise direction. FIG. 4. This operation takes place with a fuel source feeding the carburetor on the engine and the engine ignition unit—a glow plug or spark plug—energized by an electrical source. FIG. 5. The device rotates the crankshaft of the engine. This in turn moves the piston of the engine up and down. This motion draws fuel into the piston cylinder. The fuel in the piston cylinder is then compressed while the ignition unit is energized.

Once the fuel ignites, the engine begins to run and the nose cone will start to turn in the same direction as the device in the drill/driver. At this moment, the gears in the drill/driver required to generate the torque to crank the engine, now act to interfere with the engine operating on its own power. The gears in the drill/driver act as a break and inhibit the engine from catching and ruining on its own power. This phenomenon makes the use of a drill/driver gun without the use of the current invention unsuitable as a starter device for a model airplane engine.

The current invention addresses this issue by allowing the cylinder (1) to rotate faster than the shaft (2). FIG. 3. The cylinder (1) can do this because of the one direction clutch (8) in the cylinder (1) on which shaft (2) rides. FIG. 3. The ability for the engine to spin faster than the drill/driver at the moment the engine starts is critical because the engine will not catch and continue to run on its own unless it is allowed to run up faster than the device at the moment the engine begins to run on its own power.

The current invention may also be used to start engines that are inaccessible to a drill/driver in the way described herein or which do not have a nose cone or other adapter to allow the device to interface with the engine. Specifically, a v-shaped slot (5) is machined or molded into cylinder (1). FIG. 1 and FIG. 2. The v-shaped slot (5) accepts a belt which can be connected to the crankshaft of the engine. The device works the same way in this configuration as explained above.

Additionally, the instant device can be used as a fixture to a battery operated drill/driver gun as a starter on any internal combustion engine which is started by turning the crankshaft while introducing fuel into the piston cylinder and an ignition source when necessary. Internal combustion engines are used to power out door maintenance machines for the home and farm. Specifically, lawn mowers, tractors, snow blowers, weed whackers and chain saws. These machines are most often started with recoil start mechanisms referred to as a pull cords. The recoil starter mechanism consists of a rope coiled around the end of the crankshaft of the machine. When the rope is pulled the crankshaft is spun and the flywheel keeps turning to start the engine.

Figure 7:
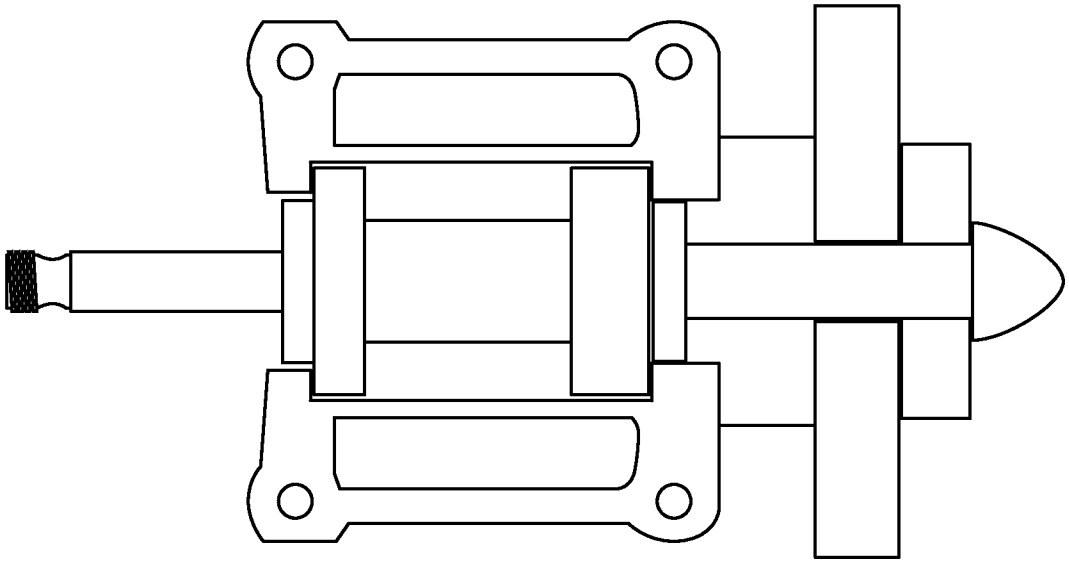
FIG. 7 is a cross-sectional view of a typical weed whacker engine showing a cone adaptor attaching to the crankshaft.

The present invention can be applied to these machines by attaching a cone adaptor to the crankshaft of the specific machine protruding out of the engine cover in the vicinity of the pull cord arrangement or in place of the pull cord arrangement. FIG. 6. and FIG. 7. In this configuration, the device chucked into the battery operated drill/driver gun can be pressed onto the cone adaptor connected to the crankshaft and spun to turn over the engine and flywheel. FIG. 6. Here again, once the fuel ignites, the engine begins to run and the cone adaptor, crankshaft and flywheel will start to turn in the same direction as the device in the drill/driver. At this moment, the gears in the drill/driver required to generate the torque to crank the engine, now act to interfere with the engine operating on its own power. The gears in the drill/driver act as a break and inhibit the engine from catching and ruining on its own power. This phenomenon makes the use of a drill/driver gun without the use of the current invention unsuitable as a starter device for these machines.

The current invention addresses this issue by allowing the cylinder (1) to rotate faster than the shaft (2). FIG. 3. The cylinder (1) can do this because of the one direction clutch (8) in the cylinder (1) on which shaft (2) rides. FIG. 3. The ability for the engine to spin faster than the drill/driver at the moment the engine starts is critical because the engine will not catch and continue to run on its own unless it is allowed to run up faster than the device at the moment the engine begins to run on its own power.

Those of ordinary skill in the art will recognize that the embodiments just described merely illustrate the principles of the present invention. Many obvious modifications may be made thereto without departing from the spirit or scope of the invention as set forth in the appended claims.

What is claimed is:

1. An internal combustion engine starter attachment for a drill/driver gun comprising:

(a) a cylinder having proximal and distal ends and extending along a longitudinal axis;

(b) the distal end of the cylinder having an opening into which an open ended adapter is inserted;

(c) the open ended adapter being pressed into the cylinder and the open end configured to fit over a cone adaptor of the engine;

(d) the proximal end of the cylinder having an opening into which a shaft is inserted;

(e) The shaft being fixed to the cylinder by a one way clutch allowing the cylinder to rotate only counterclockwise relative to the shaft; and (f) The end of the shaft opposite the portion of the shaft inserted into the one way clutch being configured to fit into a drill/driver gun.

2. A device as set forth in claim 1, wherein the open ended adapter is made of silicone.

3. A device as set forth in claim 1, wherein the open ended adapter is made of rubber.

4. A device as set forth in claim 1, wherein the open ended adapter is replaceable.

5. A device as set forth in claim 1, wherein the end of the shaft has a hex configuration.

6. A device as set forth in claim 1, wherein the outer surfaces of the cylinder has a circumferential slot.

7. A model airplane engine starter attachment for a drill/driver gun comprising:

(a) cylinder having proximal and distal ends and extending along a longitudinal axis;

(b) the distal end of the cylinder having an opening into which an open ended adapter is inserted;

(c) the open ended adapter being pressed into the cylinder and the open end configured to fit over the nose cone adaptor of an engine;

(d) the proximal end of the cylinder having an opening into which a shaft is inserted;

(e) the shaft being fixed to the cylinder by a one way clutch allowing the cylinder to rotate only counterclockwise relative to the shaft; and (f) the end of the shaft opposite the portion of the shaft inserted into the one way clutch being configured to fit into a drill/driver gun.

8. A device as set forth in claim 7, wherein the open ended adapter is made of silicone.

9. A device as set forth in claim 7, wherein the open ended adapter is made of rubber.

10. A device as set forth in claim 7, wherein the open ended adapter is replaceable.

11. A device as set forth in claim 7, wherein the end of the shaft has a hex configuration.

12. A device as set forth in claim 7, wherein the outer surfaces of the cylinder has a circumferential slot.

13. A method for starting an internal combustion engine with a battery operated drill/driver gun, comprising:

providing a fixture device with a cylinder having proximal and distal ends and extending along a longitudinal axis; the distal end of the cylinder having an opening into which an open ended adapter is inserted; the open ended adapter being pressed into the cylinder and the open end configured to fit over a cone adaptor of the engine; the proximal end of the cylinder having an opening into which a shaft is inserted; the shaft being fixed to the cylinder by a one way clutch allowing the cylinder to rotate only counterclockwise relative to the shaft; and the end of the shaft opposite the portion of the shaft inserted into the one way clutch being configured to fit into a drill/driver gun;

securing the fixture device into the chuck of a battery operated drill/driver gun;

providing a fuel supply and ignition device to an internal combustion engine;

attaching a cone adaptor to the internal combustion engine crank shaft;

pushing the open ended adapter of the fixture device onto the cone adaptor;

activating the battery operated drill/driver gun to spin the cone adaptor to turn over the internal combustion engine.

* * * * *